US007387552B2

(12) United States Patent
Iwakami et al.

(10) Patent No.: US 7,387,552 B2
(45) Date of Patent: Jun. 17, 2008

(54) TRIM ADJUSTING DEVICE FOR SMALL SURFACE BOAT

(75) Inventors: Hiroshi Iwakami, Wako (JP); Takao Kochi, Wako (JP); Tadaaki Nagata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 142 days.

(21) Appl. No.: 11/391,199

(22) Filed: Mar. 29, 2006

(65) Prior Publication Data

US 2006/0223388 A1 Oct. 5, 2006

(30) Foreign Application Priority Data

Mar. 31, 2005 (JP) ..... 2005-102017

(51) Int. Cl.
*B63H 11/113* (2006.01)
*B63H 11/107* (2006.01)

(52) U.S. Cl. ..... 440/42; 440/40

(58) Field of Classification Search ..... 440/40–42
See application file for complete search history.

(56) References Cited

U.S. PATENT DOCUMENTS 5,507,672 A * 4/1996 Imaeda ..... 440/1
2004/0116006 A1* 6/2004 Tsuchiya et al. ..... 440/40

FOREIGN PATENT DOCUMENTS

JP 3397856 4/2003

* cited by examiner

*Primary Examiner*—Lars A Olson
*Assistant Examiner*—Daniel V Venne
(74) *Attorney, Agent, or Firm*—Westerman, Hattori, Daniels & Adrian, LLP.

(57) ABSTRACT

A trim adjusting device for a surface boat is provided that includes a nozzle for projecting jet water rearward arranged rearwardly of a jet propeller arranged in a boat body; a nozzle drive mechanism connected to the nozzle for operating the nozzle upward or downward; and an operating means arranged on a handle being connected to the nozzle drive mechanism. The nozzle drive mechanism includes a lever member connected to a trim operation lever of the operating means, a cam member provided with an engaging portion that engages the lever member arranged so as to be capable of rotating freely, a reverse rotation preventing claw member that engages the engaging portion, a link member that comes into abutment with the cam member at one end thereof, and the nozzle connected to the other end of the link member.

2 Claims, 8 Drawing Sheets

TRIM ADJUSTING DEVICE FOR SMALL SURFACE BOAT

TECHNICAL FIELD

The present invention relates to a trim adjusting device for a small surface boat, which directs a nozzle for projecting jet water upward or downward.

BACKGROUND OF THE INVENTION

Trim adjusting devices for small surface boats have been known, in which the direction of a nozzle is changed by an electric power by operating an operating unit arranged on a handle.

For example, Japanese Patent No. 3397856 discloses a technique in which the direction of a nozzle is changed by operating an operating unit provided on a handle and pulling a cable connected to the operating unit. In this reference, a trim adjusting device for a jet-propelled boat is configured in such a manner that by squeezing and rotating an outer pipe 22 arranged on an operating handle 2 by hand and pulling one of operating cables 60, 60, a rotary plate 32 of a converter 3 rotates, pulls and pushes an operating cable 30, whereby a water injection port 5 can be directed obliquely upward or obliquely downward.

However, one problem associated with this type of trim adjusting device is that when the operator grips and rotates the outer pipe 22 disposed on the operating handle 2 by hand, the operator's hand may slip unless the operator grips with a strong grip, and hence the operator has to grip with a strong force. In particular, when it is operated during travel, the operator has to operate the water injection port 5 to be directed obliquely upward or obliquely downward against a pressure of jet water being injected. Therefore, the operator has to rotate the outer pipe 22 with a strong force and with a strong grip, which is difficult to operate.

According to the trim adjusting device disclosed Japanese Patent No. 3397856, the water injection port 5 is directed obliquely upward or obliquely downward by an angle corresponding to notches 71, 73 formed on a housing 7 of the operating handle 2. However, the water injection port 5 cannot be directed to other angles, for example, further downward than in the related art.

SUMMARY OF THE INVENTION

According to one aspect of the present invention, a trim adjusting device for a small surface boat includes a nozzle for projecting jet water rearward arranged rearwardly of a jet propeller arranged in a boat body, a nozzle drive mechanism connected to the nozzle for operating the nozzle upward or downward, and operating means arranged on a handle being connected to the nozzle drive mechanism. The nozzle drive mechanism includes a lever member connected to a trim operation lever of the operating means, a cam member provided with an engaging portion that engages the lever member arranged so as to be capable of rotating freely, the reverse rotation preventing claw member that engages the engaging portion, a link member that comes into abutment with the cam member at an one end thereof, and the nozzle connected to the other end of the link member.

In the trim adjusting device, for example, since the cam member rotates the link member while rotating by a predetermined angle via the lever member when the trim operation lever is squeezed by hand, the nozzle connected to the link member can be directed obliquely upward or obliquely downward.

Accordingly, the nozzle drive mechanism includes the lever member connected to the trim operation lever of the operating means, the cam member provided with the engaging portion that engages the lever member arranged so as to be capable of rotating freely, the reverse rotation preventing claw member that engages the engaging portion, the link member that comes into abutment with the cam member at the one end thereof, and the nozzle connected to the other end of the link member. Therefore, only by squeezing the trim operation lever of the operating means, the nozzle can be directed obliquely upward or obliquely downward against a pressure of jet water by the trim operation lever, the lever member, the cam member and the link member during travel with jet water being injected from the nozzle even when the operating force by hand is small. Consequently, the trim adjustment of the small surface boat can be achieved with a small force. Therefore, the operating force necessary for trim-adjusting the small surface boat can be reduced.

Also, the link member can be rotated in dual-angle adjustment by the cam member, so that the nozzle can be directed downward at the first angle, and further downward in comparison with the first angle at the second angle. Therefore, the nozzle can be directed downward advantageously at dual-angle adjustment.

According to another aspect of the present invention, a cam body of the cam member includes a plurality of contact portions that come into contact with the link member for determining the direction of the nozzle in the vertical direction, and a straight contact portion provided between an upper contact portion which causes the nozzle to be directed upward and a lower contact portion which causes the nozzle to be directed downward for causing the nozzle to be directed constantly in the straight position.

Therefore, whether the trim is adjusted from upward to downward or from downward to upward, there is always a position that is directed to straight in-between and hence the trim adjustment can be performed always slowly.

BRIEF DESCRIPTION OF THE DRAWINGS

The preferred embodiments of the present invention are shown by way of example, and not limitation, in the accompanying figures, in which.

DETAILED DESCRIPTION OF THE INVENTION

Figure 1:
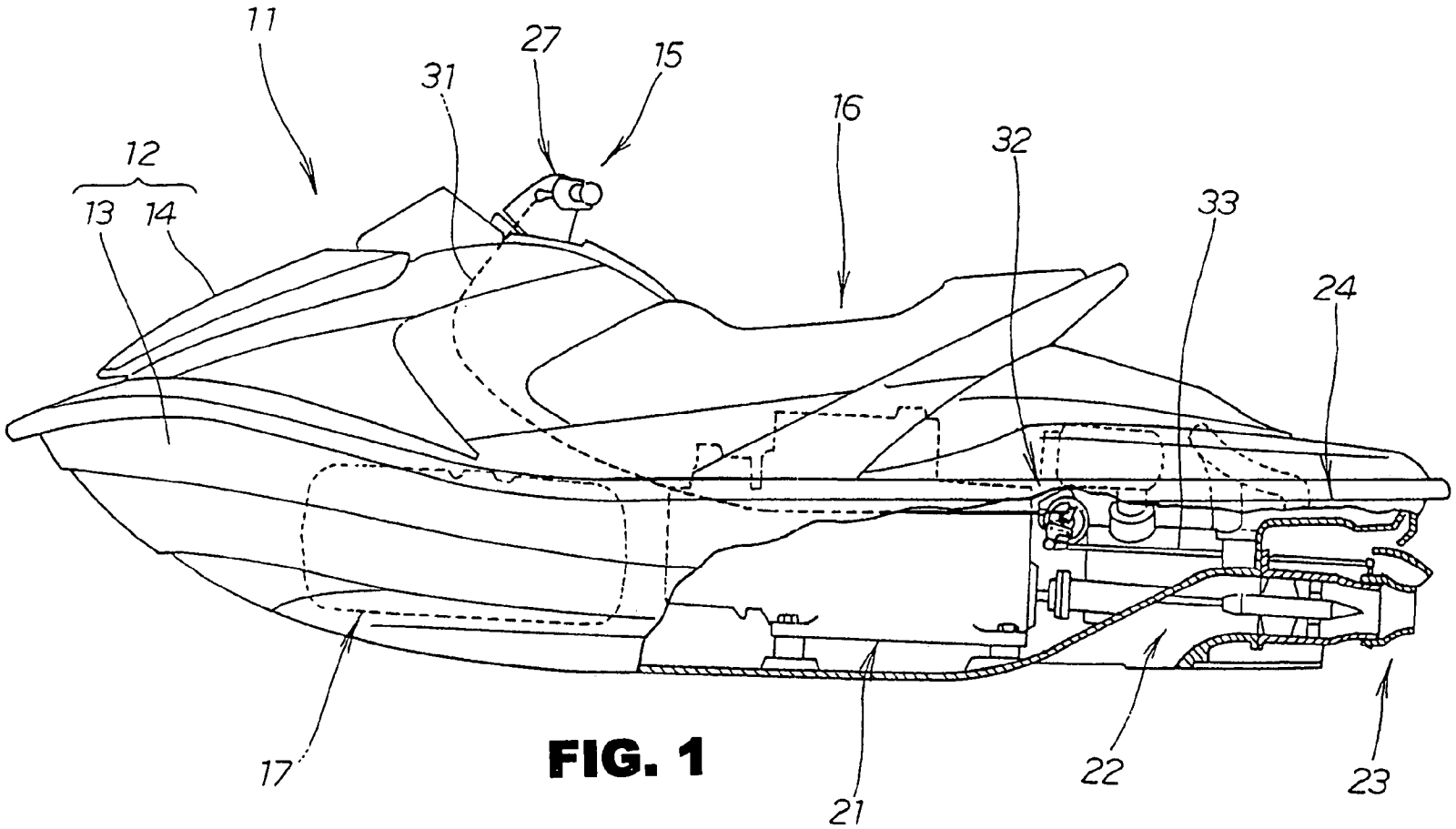
FIG. 1 is a side view of a small surface boat in which a trim adjusting device according to one aspect of the invention is employed.

Referring to the attached drawings, a best mode for carrying out the invention will be described. The drawings are to be viewed in the orientation in which reference numerals can be seen in a correct way.

FIG. 1 is a side view of a small surface boat in which a trim adjusting device according to the invention is employed.

A small surface boat 11 includes a boat body 12 composed of a hull 13 and a deck 14 joined onto the hull 13, a steering handle 15 as a handle arranged at a substantially center of the deck 14, a seat 16 provided rearwardly of the steering handle 15 and placed on the deck 14, a fuel tank 17 and an engine 21 mounted to a center of the hull 13, a water jet propeller 22 connected to the engine 21, a steering nozzle 23 as a nozzle arranged rearwardly of the water jet propeller 22 and a trim adjusting device 24 including the steering nozzle 23.

The trim adjusting device 24 includes operating means 27 mounted to the steering handle 15, a pull cable 31 connected to the operating means 27, a nozzle driving mechanism 32 connected to the pull cable 31, a push-pull cable 33 connected to the nozzle driving mechanism 32 and the steering nozzle 23 connected to the push-pull cable 33. Reference numeral 31*a* designates a cable outer.

Figure 2:
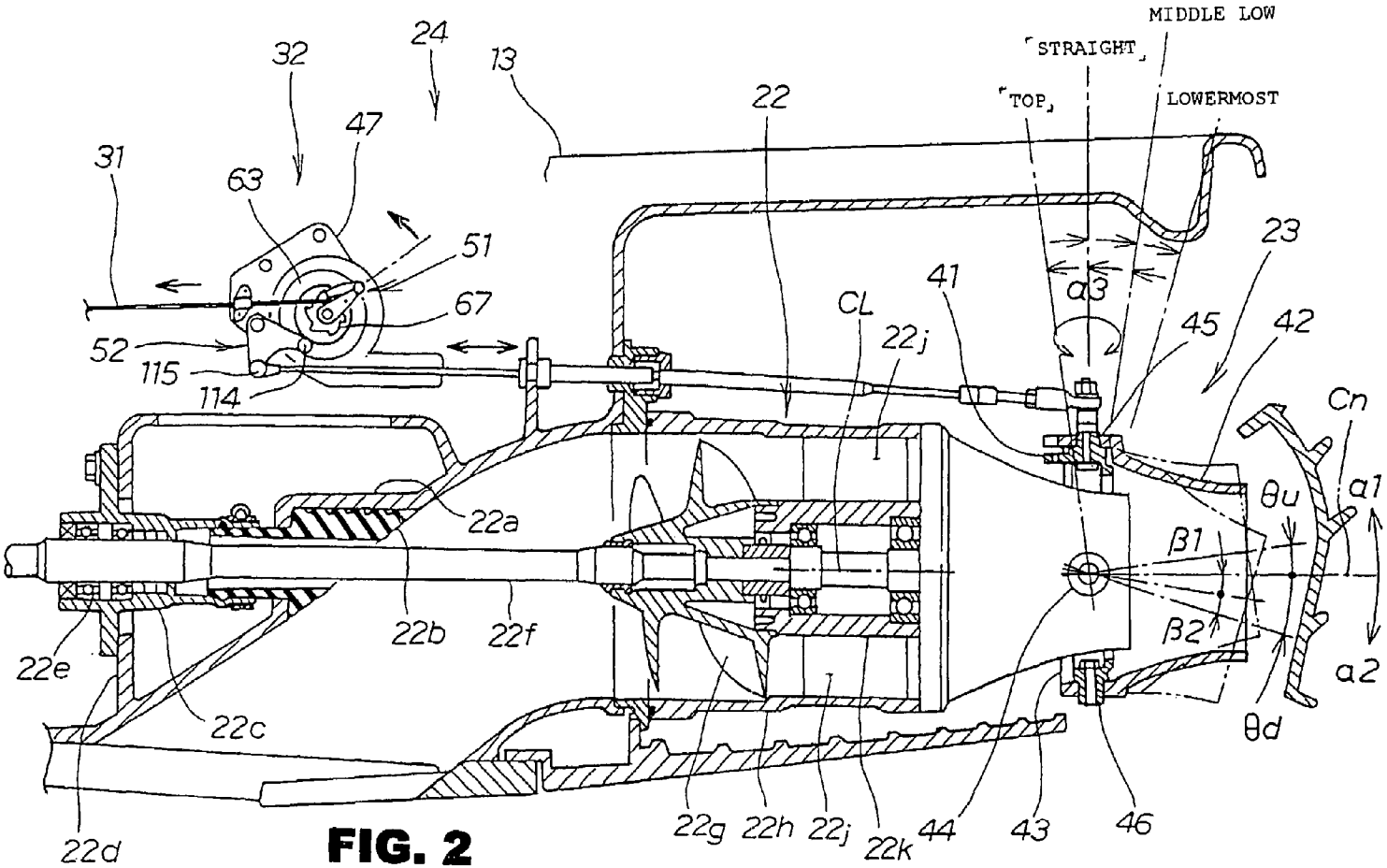
FIG. 2 is a drawing showing a cross section of a steering nozzle and an interior of a nozzle driving mechanism provided in the trim adjusting device according to the invention.

FIG. 2 illustrates a cross section of the steering nozzle and an interior of the nozzle driving mechanism provided in the trim adjusting device according to the invention.

The water jet propeller 22 injects jet water and includes a recess 22*a* formed on the hull 13, a rubber made connecting member 22*b* fitted to the recess 22*a*, a rubber-made shaft support 22*c* connected to the connecting member 22*b*, a cover 22*d* formed on the hull 13 for mounting the shaft support 22*c*, the drive shaft 22*f* fitted to the shaft support 22*c* via a bearing 22*e*, an impeller 22*g* fitted to the drive shaft 22*f*, a cylindrical stator 22*h* for covering the outside of the impeller 22*g*, and a bearing portion 22*k* arranged to the stator 22*h* via a plurality of stays 22*j*.

The steering nozzle 23 is configured in such a manner that a ring member 41 is mounted to the water jet propeller 22 so as to be pivotable upward (in a direction indicated by an arrow a1) or downward (in a direction indicated by an arrow a2), and a nozzle body 42 is mounted to the ring member 41 so as to be pivotable leftward or rightward (in a direction indicated by an arrow a3), and adjusts the direction of injection of jet water.

The ring member 41 is formed with first receiving portions 44, 44 (not shown in the drawing) on the left and right (front and back of the drawing) of a ring body 43 so as to be connected to the water jet propeller 22, and with second receiving portions 45, 46 on top and bottom so as to be connected to the nozzle body 42. Reference sign Cn designates a central axis line of the nozzle body 42.

The nozzle body 42 of the steering nozzle 23 can be pivoted freely upward by a trim angle θu with respect to a central axis line CL of the water jet propeller 22 via the ring member 41 and downward by a trim angle θd with respect to the central axis line CL via the ring member 41.

The trim angle θu is a normal position, which is set, for example, to 3°. A state at the trim angle θu is referred to as "top".

The trim angle θd is obtained by adding a first trim angle β1 and a second trim angle β2, and is set to, for example, to 6° from θd=2×θu, and β1 and β2 are both set to 3°. A state at the trim angle θd is referred to as "lowermost" and the state of the first trim angle β1 is referred to as "middle-low".

A state in which the central axis line Cn of the nozzle body 42 is aligned with the central axis line CL of the water jet propeller 22 is referred to as "straight".

The nozzle drive mechanism 32 includes a case member 47 mounted to the hull 13, a cover (not shown in the drawing) to be mounted to the case member 47, a lever member 51 arranged on the case member 47 and connected to the operating means 27 (see FIG. 1), and a link member 52 arranged on the case member 47 and connected to the second receiving portion 45 of the steering nozzle 23. Detailed description will be given later.

Figure 3:
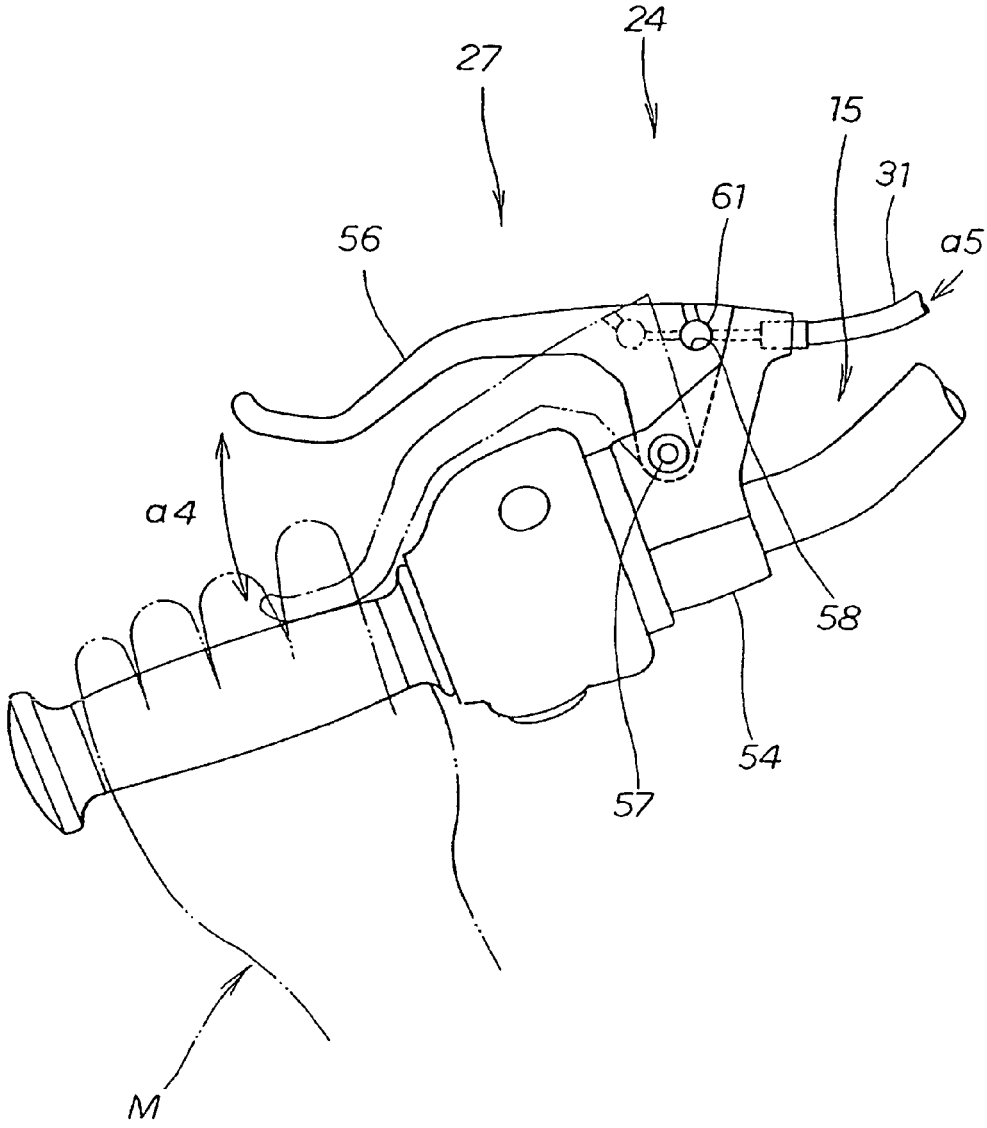
FIG. 3 is a perspective view of the operating means employed in the trim adjusting device according to one aspect of the invention.

FIG. 3 is a perspective view of the operating means employed in the trim adjusting device according to the invention.

The operating means 27 includes a supporting member 54 mounted to the steering handle 15, a trim operation lever 56 mounted to the supporting member 54 with a bolt 57 so as to be pivotable (in a direction indicated by an arrow a4), and a first hooking hole 58 formed on the trim operation lever 56 so that a first end 61 of the pull cable 31 is hooked up therewith, and is configured in such a manner that when the trim operation lever 56 is squeezed by a hand M as shown by a double-dashed line, a steel wire of the pull cable 31 is pulled (in a direction indicated by an arrow a5).

Subsequently, the nozzle driving mechanism 32 of the small surface boat 11 will be described in detail.

Figure 4:
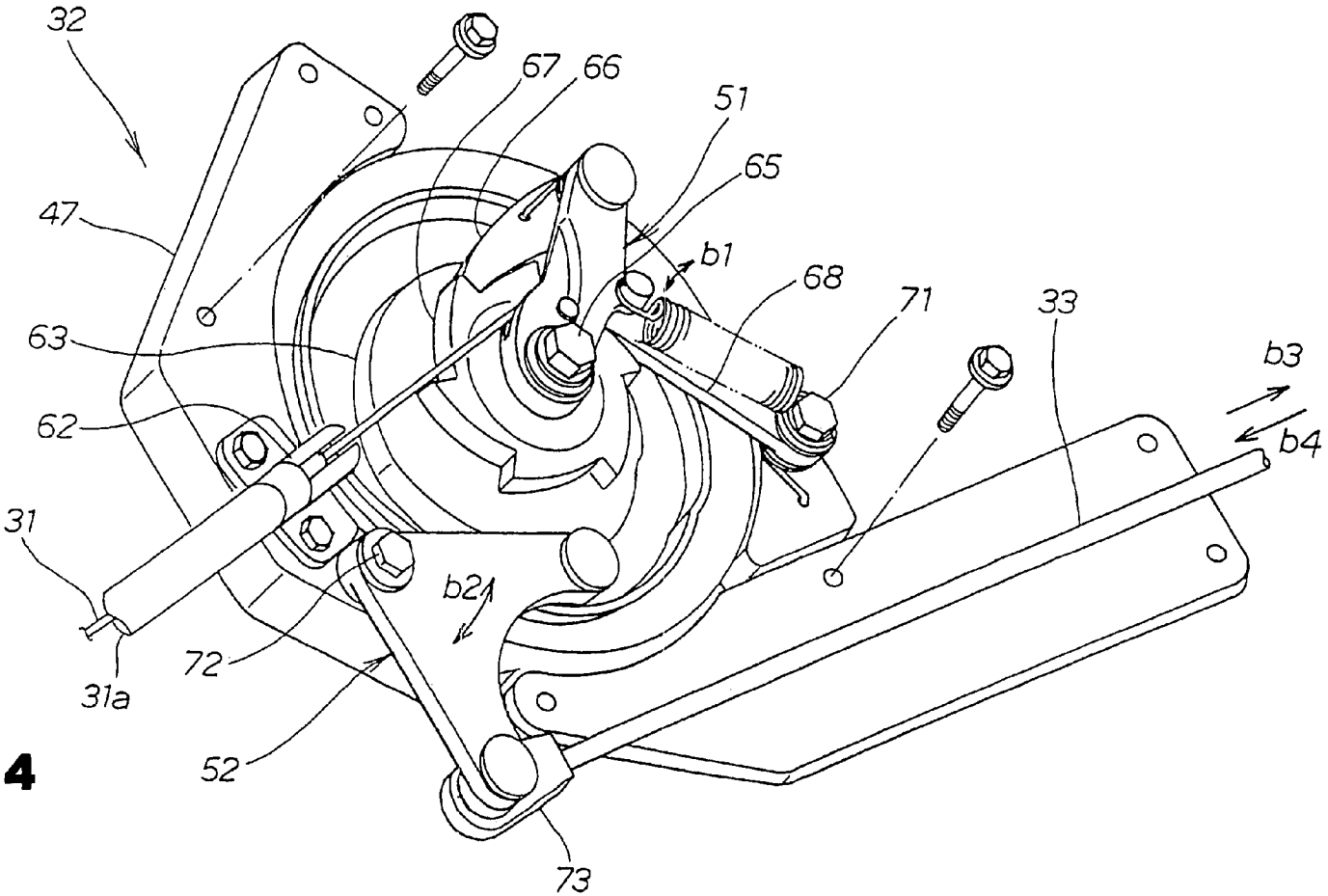
FIG. 4 is a perspective view of the nozzle driving mechanism employed in the trim adjusting device according to one aspect of the invention.

FIG. 4 is a perspective view of the nozzle driving mechanism employed in the trim adjusting device according to the invention.

The nozzle driving mechanism 32 is specifically assembled by mounting a cable fitting member 62 for fitting the pull cable 31 to an end of the case member 47, rotatably disposing a cam member 63 at a center of the case member 47, superimposing the lever member 51 on the cam member 63 and rotatably securing the same with a bolt 65, connecting the lever member 51 to the cam member 63 by engaging an engaging claw member 66 thereof with an engaging portion 67 of the cam member 63, mounting a reverse rotation preventing claw member 68 that engages the engaging portion 67 to an end of the case member 47 with a rocking bolt 71 so as to be pivotable (in a direction indicated by an arrow b1), mounting a link member 52 that follows the cam member 63 to an end of the case member 47 with a rocking bolt 72 so as to be pivotable (in a direction indicated by an arrow b2), and connecting a connecting member 73 of the push-pull cable 33 to the link member 52, thereby pushing (in a direction indicated by an arrow b3) and pulling (in a direction indicated by an arrow b4) the push-pull cable 33.

Figure 5:
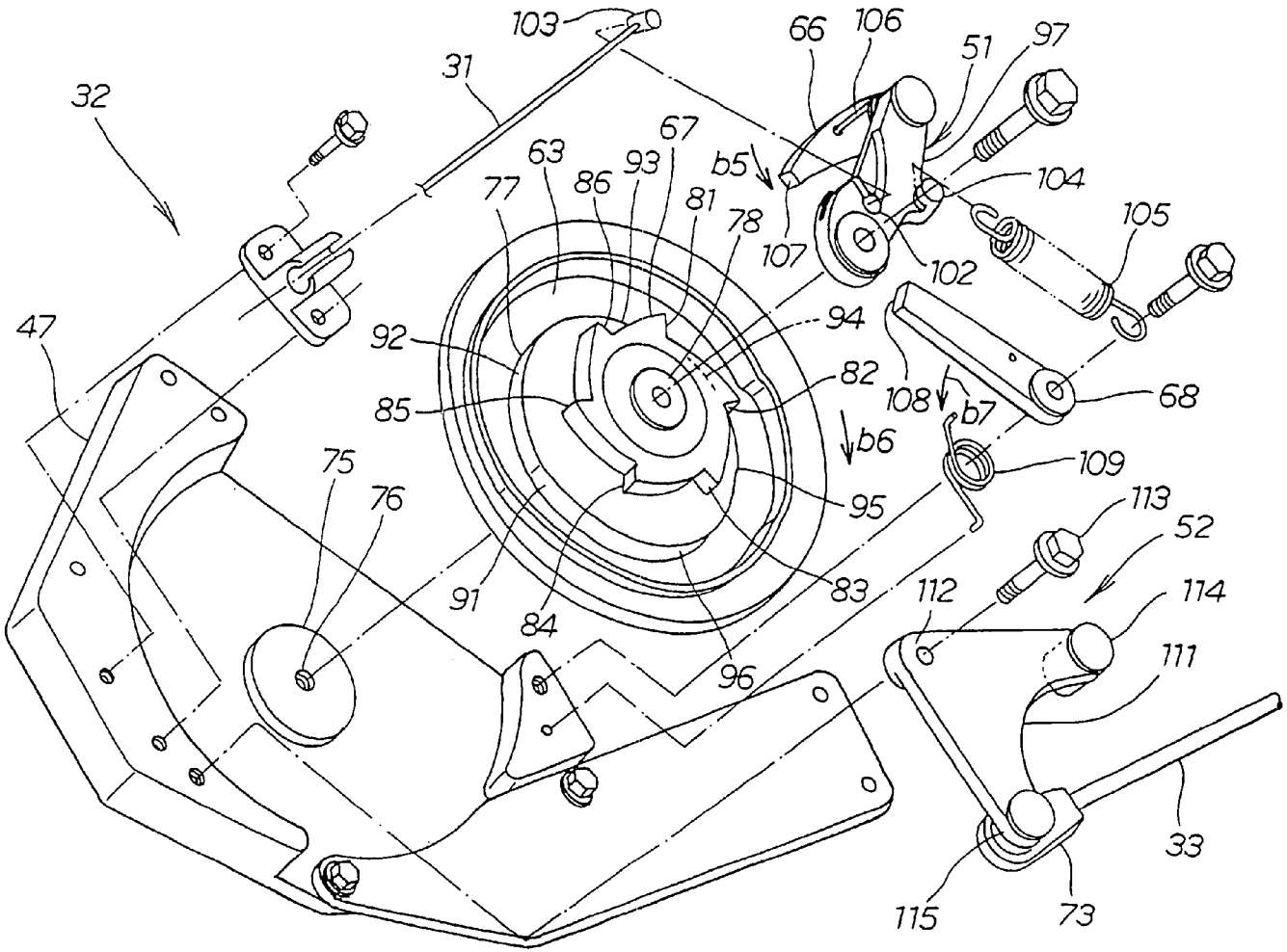
FIG. 5 is an exploded view of the nozzle drive mechanism employed in the trim adjusting device according to one aspect of the invention.

FIG. 5 is an exploded view of the nozzle drive mechanism employed in the trim adjusting device according to the invention.

The case member 47 includes a boss 75 as a fulcrum of the cam member 63 and the engaging portion 67 at a center thereof, and the boss 75 is formed with a female screw portion 76.

The cam member 63 is made up by forming a groove cam body 77, forming the engaging portion 67 so as to continue from a side surface of the groove cam body 77, forming a hole (not shown in the drawing) to be fitted onto the boss 75 at centers thereof, and forming a projection 78 on the side surface of the engaging portion 67 for fitting the lever member 51 thereon.

The engaging portion 67 is a portion formed with first to sixth teeth 81-86 at center angles of 60°, for example.

The groove cam body 77 is a groove cam having first to sixth contact portions 91-96 corresponding to the first to sixth teeth 81-86 formed continuously in a groove shape.

The first contact portion 91 is a portion at a highest level from the center of the groove cam body 77, and is an upper contact portion which corresponds to "top".

The fourth contact portion 94 is a portion at a lowest level from the center of the groove cam body 77, and is a lower contact portion which corresponds to the "lowermost".

The second and sixth contact portions 92, 96 are straight contact portions.

The third to fifth contact portions 93 to 95 are lower contact portions.

The lever member 51 is a component made up by forming a hole (not shown in the drawing) at one end thereof to be fitted on the projections 78 of a main body 97, forming a second hooking hole 102 at a center thereof so that a second end 103 of the pull cable 31 is hooked up therewith, forming a projection 104 at the center thereof so that a tension spring 105 is engaged, connecting the engaging claw member 66 to the other end thereof so as to be pivotable, hooking a spring 106 between the engaging claw member 66 and the other end of the main body 97 so as to exert a pushing force (in a direction indicated by an arrow b5) to the engaging claw member 66, and forming a pushing end 107 on the engaging claw member 66 so as to push the engaging portion 67.

Although the lever member 51 is adapted to push the engaging portion 67 of the cam member 63, whether it pushes or pulls the engaging portion 67 is arbitrary, and must simply be configured to rotate the cam member 63.

The reverse rotation preventing claw member 68 is formed into a flat rectangular plate, and prevents the cam member 63 from rotating in the opposite direction (the direction indicated by an arrow b6) by bringing a distal end portion 108 thereof into abutment with anyone of the first to sixth teeth 81-86 of the engaging portion 67. Reference numeral 109 is a spring that exerts a pushing force (in a direction indicated by an arrow b7) to the reverse rotation preventing claw member 68.

The link member 52 is a component made up by forming a triangular plate body 111, mounting a fulcrum portion 112 formed at a first corner of the plate body 111 to the case member 47 so as to be pivotable with a bolt 113, forming a contact end 114, which corresponds to an end, at a second corner so as to be fitted to the groove come body 77, and forming a joint portion 115, which corresponds to the other end, at a third corner so as to connect the connecting member 73 of the push-pull cable 33.

Although the triangular plate body 111 is formed in the link member 52, the triangular shape is an example, and other shapes may be employed as desired. For example, it may be composed of a bar member.

Next, an operation of the trim adjusting device 24 of the small surface boat according to the invention is described.

As shown in FIG. 2, in the trim adjusting device 24, the nozzle (steering nozzle) 23 is operated in sequence of "top" as a normal position→"straight" position→"middle low" position→"lowermost" position→"middle low" position→"straight" position→"top" position.

The normal position may be set "top" or "straight" as desired.

Figure 6:
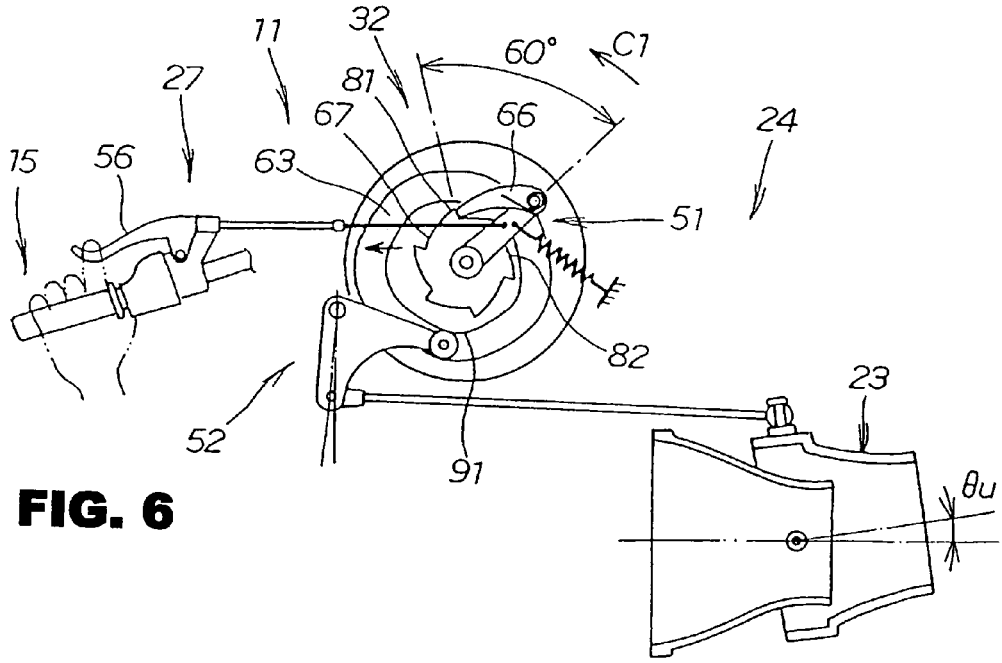
FIG. 6 is an operational drawing when operating a nozzle of the trim adjusting device upward according to one aspect of the invention.

FIG. 6 is an operational drawing when operating the nozzle of the trim adjusting device upward according to the invention.

As shown in FIGS. 4 and 5, in the small surface boat 11, the steering nozzle 23 as the nozzle is directed upward by setting the trim adjusting device 24 to "top" position in the normal state. As a consequence, the maximum speed of the small surface boat 11 can be increased in comparison with the case in which the steering nozzle 23 is directed to be "straight" position. More specifically, since a drive shaft for connecting the engine 21 and the water jet propeller 22 to the small surface boat 11 is mounted so as to be inclined downward toward the rear, the direction of the water jet propeller is also inclined downward toward the rear. Therefore, water can be injected substantially horizontally when the steering nozzle 23 is directed upward (the trim angle θu), and therefore the maximum speed can be increased.

In other words, when the engaging claw member 66 of the lever member 51 comes into abutment with the first tooth 81 of the engaging portion 67, and simultaneously, the reverse rotation preventing claw member 68 is hooked up with the second tooth 82 and the link member 52 comes into abutment with the first contact portion 91 of the cam member 63, the steering nozzle 23 is directed upward and is kept in this state. Consequently, it is not necessary to provide a holding force of a high output by a spring or electricity for constantly holding the nozzle (steering nozzle) 23 to the "top" position as the upward direction against the pressure of jet water. Therefore, the structure of the trim adjusting device 24 is simplified.

Figure 7:
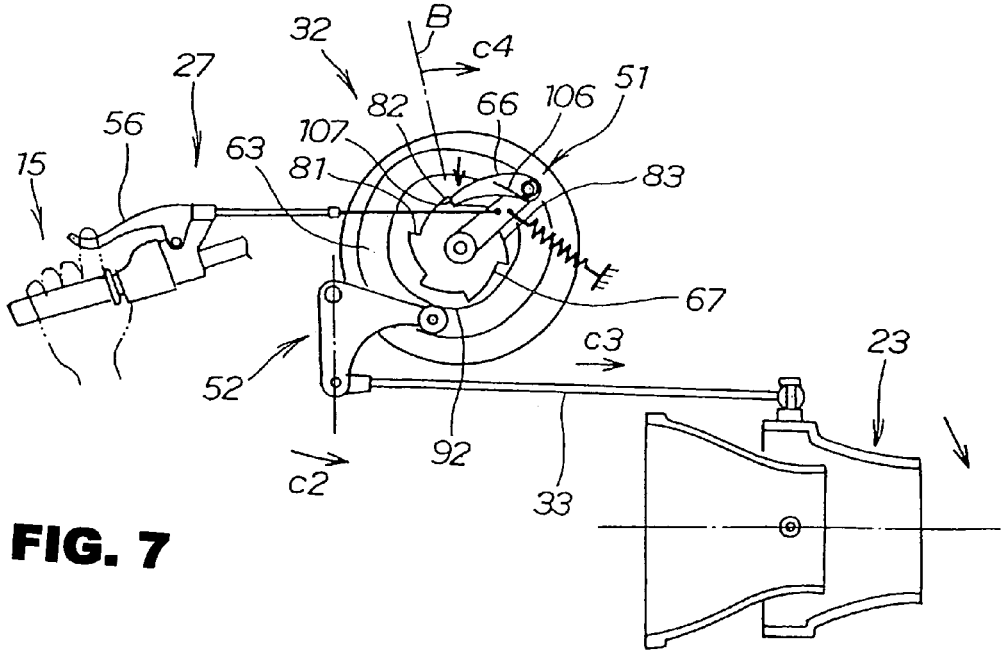
FIG. 7 is an operational drawing when the nozzle of the trim adjusting device according to one aspect of the invention is moved from the upward direction to the straight direction in parallel with a jet propeller.

FIG. 7 is an operational drawing when the nozzle of the trim adjusting device according to the invention is moved from the upward direction to the straight direction in parallel with the jet propeller.

When the nozzle (steering nozzle) 23 in FIG. 6 is directed to the "top" position and the trim operation lever 56 of the operating means 27 is squeezed, the engaging claw member 66 pushes the first tooth 81 as shown by an arrow c1 and rotates the cam member 63 by a rotational angle of 60° in association with pivotal movement of the lever member 51 of the nozzle drive mechanism 32 (in a direction indicated by the arrow c1). Therefore, as shown in FIG. 7, the link member 52 is guided by the cam member 63 to the second contact portion 92 as shown by an arrow c2, and hence pushes the push-pull cable 33 (in a direction indicated by an arrow c3), thereby bringing the nozzle 23 to "straight" position.

When the cam member 63 is rotated by the rotational angle of 60°, for example, the second tooth 82 moves away from the reverse rotation preventing claw member 68, and then the third tooth 83 rotates toward and passes through the distal end portion 108 of the reverse rotation preventing claw member 68. Therefore, the distal end portion 108 of the reverse rotation preventing claw member 68 comes into abutment with the third tooth 83 by the spring 109, whereby return (reverse rotation) of the engaging portion 67 is constrained.

Subsequently, when the trim operation lever 56 arranged on the steering handle 15 is released, the lever member 51 of the nozzle drive mechanism 32 is pivoted and returned from the limit of rotation B as shown by an arrow c4, and the pushing end 107 of the engaging claw member 66 comes into abutment with the second tooth 82 which is rotating and approaching thereto by the spring 106.

In other words, when the trim operation lever 56 is squeezed and then released, the nozzle 23 can be moved from the "top" position in the normal state to the "straight" position.

Figure 8:
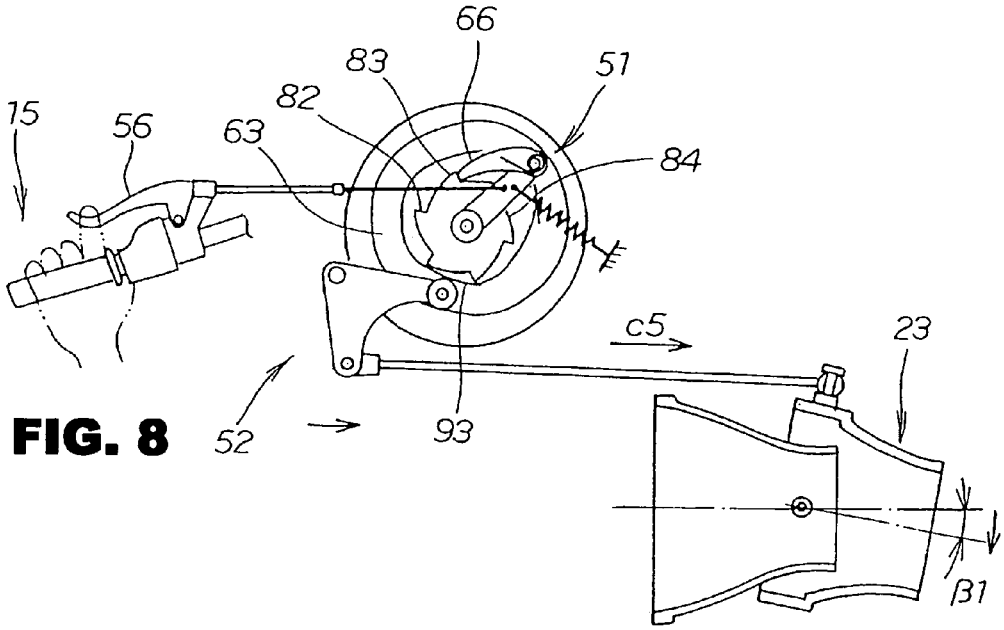
FIG. 8 is an operational drawing showing a state in which the nozzle of the trim adjusting device according to one aspect of the invention is moved downward from the "straight" position in FIG. 7.

FIG. 8 is an operational drawing showing a state in which the nozzle of the trim adjusting device according to the invention is moved downward from the "straight" position in FIG. 7.

When the trim operation lever 56 arranged on the steering handle 15 shown in FIG. 7 is squeezed, the lever member 51 pushes the second teeth 82 and rotates the cam member 63 by the rotational angle of 60°. Therefore, as shown in FIG. 8, the link member 52 is guided to the third contact portion 93 by the cam member 63 and hence pushes the push-pull cable 33 (in a direction indicated by an arrow c5), and brings the nozzle (steering nozzle) 23 to the "middle low" position. In this case, the engaging claw member 66 of the lever member 51 comes into abutment with the third tooth 83, whereby the reverse rotation preventing claw member 68 comes into abutment with the fourth tooth 84.

In other words, when the trim operation lever 56 is squeezed and then released, the nozzle 23 can be moved from the "straight" position to the "middle low" position.

Figure 9:
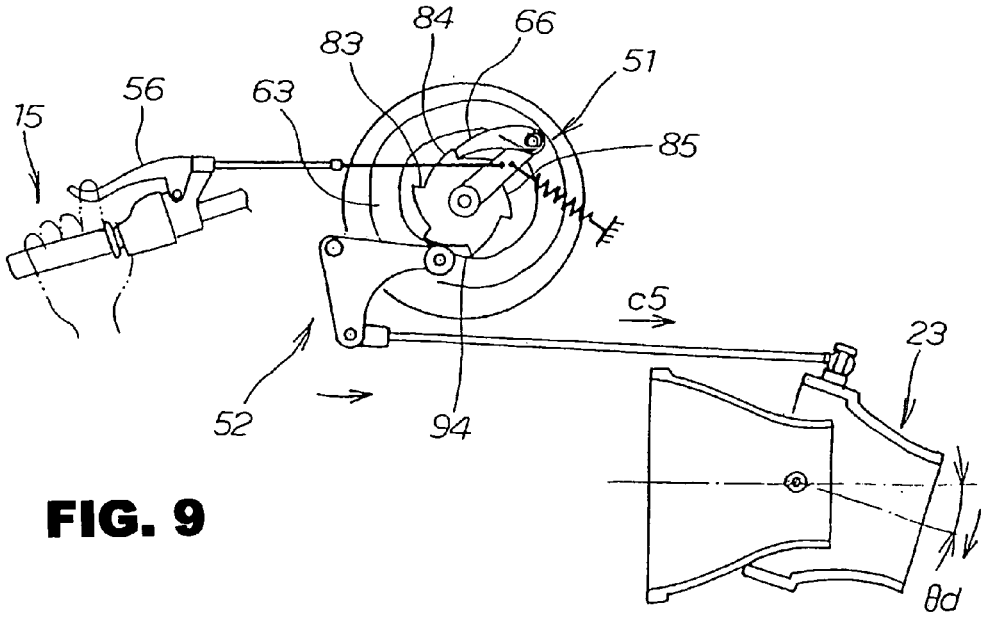
FIG. 9 is an operational drawing showing a state in which the nozzle of the trim adjusting device according to one aspect of the invention is moved further downward than the state shown in FIG. 8.

In this manner, in the trim adjusting device 24, the nozzle drive mechanism 32 includes the lever member 51 connected to the trim operation lever 56 of the operating means 27, the cam member 63 provided with the engaging portion 67 that engages the lever member 51 arranged so as to be capable of rotating freely, the reverse rotation preventing claw member 68 that engages the engaging portion 67, the link member 52 that comes into abutment with the cam member 63 at one end (contact end) 114 thereof, and the nozzle (steering nozzle) 23 connected to the other end (joint portion) 115 of the link member 52. Therefore, only by squeezing the trim operation lever 56 of the operating means 27, the nozzle 23 can be moved to the "middle low" position against the pressure of jet water by the trim operation lever 56, the lever member 51, the cam member 63 and the link member 52. Therefore, the operating force required for adjusting the trim of the small surface boat 11 can be reduced FIG. 9 is an operational drawing showing a state in which the nozzle of the trim adjusting device according to the invention is moved further downward than the state shown in FIG. 8.

When the trim operation lever 56 arranged on the steering handle 15 shown in FIG. 8 is squeezed, the lever member 51 pushes the third tooth 83 and rotates the cam member 63 by the rotational angle of 60°. Therefore, as shown in FIG. 9, the link member 52 is guided to the fourth contact portion 94 by the cam member 63 and hence pushes the push-pull cable 33 (in the direction indicated by the arrow c5), whereby the nozzle 23 is moved to the "lowermost" position. In this case, the engaging claw member 66 of the lever member 51 comes into abutment with the fourth tooth 84, and the reverse rotation preventing claw member 68 comes into abutment with the fifth tooth 85.

In other words, when the trim operation lever 56 is squeezed and then released, the nozzle 23 can be moved from the "middle low" position to the "lowermost" position.

Since the trim adjusting device 24 includes the trim operation lever 56, the lever member 51, the cam member 63 and the link member 52, the nozzle 23 can be brought to the "lowermost" position against the high pressure even when the pressure of jet water is increased only by squeezing the trim operation lever 56. Therefore, the operating force required for adjusting the trim of the small surface boat 11 can be reduced.

In this manner, in the trim adjusting device 24, the nozzle drive mechanism 32 includes the lever member 51 connected to the trim operation lever 56 of the operating means 27, the cam member 63 provided with the engaging portion 67 that engages the lever member 51 arranged so as to be capable of rotating freely, the reverse rotation preventing claw member 68 that engages the engaging portion 67, the link member 52 that comes into abutment with the cam member 63 at the one end (contact end) 114 thereof, and the nozzle 23 connected to the other end (joint portion) 115 of the link member 52. Therefore the link member 52 can be rotated in dual step by the cam member 63, so that the nozzle 23 can be directed to the "middle low" position and the "lowermost" position in dual-angle adjustment.

Figure 10:
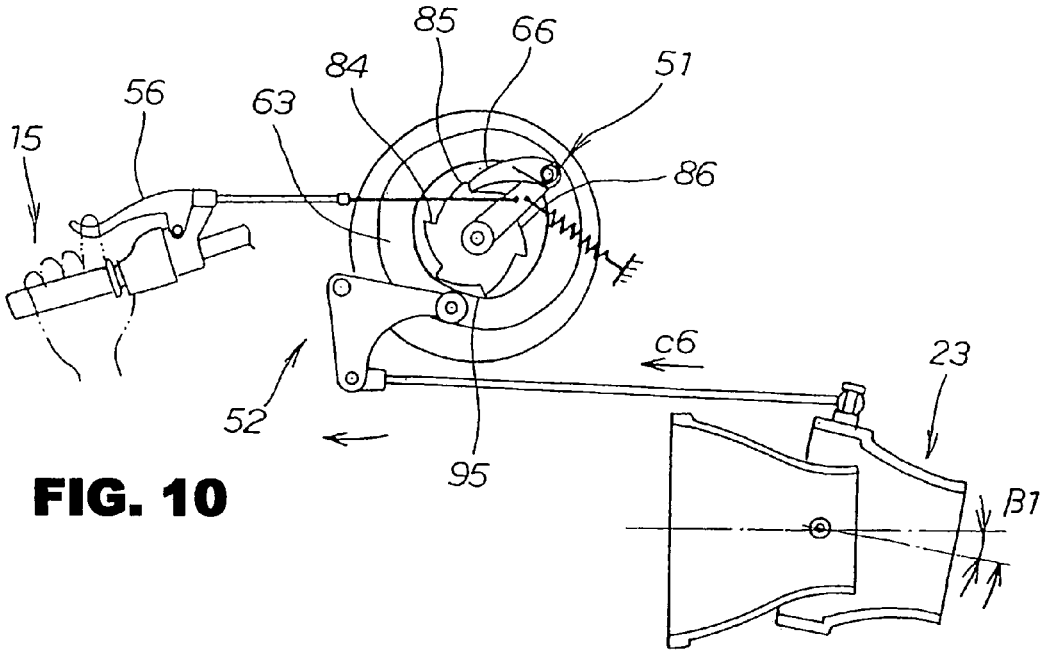
FIG. 10 is an operational drawing showing a state in which the nozzle of the trim adjusting device according to one aspect of the invention is returned downward shown in FIG. 8.

FIG. 10 is an operational drawing showing a state in which the nozzle of the trim adjusting device according to the invention is returned downward shown in FIG. 8.

When the trim operation lever 56 arranged on the steering handle 15 shown in FIG. 9 is squeezed, the lever member 51 pushes the fourth tooth 84 and rotates the cam member 63 by a rotational angle of 60°. Therefore, as shown in FIG. 10, the link member 52 is guided to the fifth contact portion 95 by the cam member 63 and hence pull the push-pull cable 33 (in a direction indicated by an arrow c6), and brings the nozzle 23 to the "middle low" position. At this time, the engaging claw member 66 of the lever member 51 comes into abutment with the fifth tooth 85, and the reverse rotation preventing claw member 68 comes into abutment with the sixth tooth 86.

In other words, when the trim operation lever 56 is squeezed and then released, the nozzle 23 can be moved from the "lowermost" position to the "middle low" position.

Figure 11:
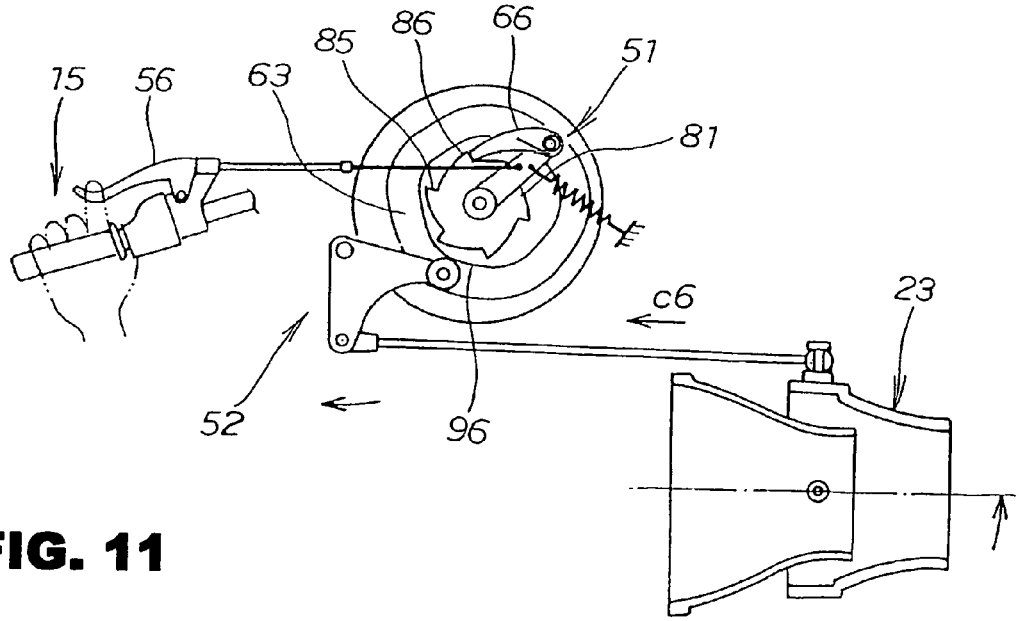
FIG. 11 is an operational drawing in a state in which the nozzle of the trim adjusting device according to one aspect of the invention is operated from the downward direction shown in FIG. 10 to the straight position.

FIG. 11 is an operational drawing in a state in which the nozzle of the trim adjusting device according to the invention is operated from the downward direction shown in FIG. 10 to the straight position.

When the trim operation lever 56 arranged on the steering handle 15 shown in FIG. 10 is squeezed, the lever member 51 pushes the fifth tooth 85 and rotates the cam member 63 by a rotational angle of 60°. Therefore, as shown in FIG. 11, the link member 52 is guided to the sixth contact portion 96 by the cam member 63 and hence pull the push-pull cable 33 (in the direction indicated by the arrow c6), and brings the nozzle 23 to the "straight" position. At this time, the engaging claw member 66 of the lever member 51 comes into abutment with the sixth tooth 86, and the reverse rotation preventing claw member 68 comes into abutment with the first tooth 81.

In other words, when the trim operation lever 56 is squeezed and then released, the nozzle 23 can be moved from the "middle low" position to the "straight" position.

When the trim operation lever 56 arranged on the steering handle 15 is squeezed, the nozzle 23 is returned to the "top" as the normal position shown in FIG. 6.

In this manner, in the trim adjusting device 24, the operating force when adjusting the trim can be reduced, and the nozzle 23 can be directed downward in dual-angle adjustment.

In the trim adjusting device 24, since the nozzle drive mechanism 32 includes the lever member 51 connected to the trim operation lever 56 of the operating means 27, the cam member 63 provided with the engaging portion 67 that engages the lever member 51 arranged so as to be capable of rotating freely, the reverse rotation preventing claw member 68 that engages the engaging portion 67, the link member 52 that comes into abutment with the cam member 63 at the one end (contact end) 114 thereof, and the nozzle 23 connected to the other end (joint portion) 115 of the link member 52, it is not necessary to use a prime mover, whereby the production cost can be reduced.

As shown in FIG. 3, since the trim adjusting device 24 includes the trim operation lever 56 of the operating means 27, an existing trim operation lever can be used according to the conditions.

Since the trim adjusting device 24 includes the trim operation lever 56 of the operating means 27, the lever member 51, the cam member 63 and the link member 52, a cable connecting to the trim operation lever 56 can be only the pull cable 31, and hence a cable assembling work can be facilitated.

Although the trim adjusting device of the small surface boat according to the invention is employed on the small surface boat in the embodiment, it can also be employed in general surface boats.

We claim:

1. A trim adjusting device for a small surface boat, comprising:

a nozzle for projecting jet water rearward, said nozzle located rearwardly of a jet propeller disposed in a boat body;

a nozzle drive mechanism connected to the nozzle for operating the nozzle upward or downward; and operating means disposed on a handle, and connected to the nozzle drive mechanism, said operating means having a trim operation lever, wherein said nozzle drive mechanism includes a lever member connected to said trim operation lever, a cam member having an engaging portion that engages said lever member, a reverse rotation preventing claw member engageable with said engaging portion, and a link member having a first end and a second end, said first end abutting said cam member and said second end connected to the nozzle.

2. The trim adjusting device according to claim 1, said cam member further comprising a cam body, said cam body including:

a plurality of contact portions for contacting the link member for determining the direction of the nozzle in a vertical direction.

a straight contact portion is provided between an upper contact portion which directs the nozzle upward and a lower contact portion which causes the nozzle to be directed downward, wherein the nozzle is always in the straight position.

* * * * *